United States Patent [19]

Bianchi

[11] Patent Number: 4,865,238

[45] Date of Patent: Sep. 12, 1989

[54] HOLSTER WITH INTERCHANGABLE SPRING

[75] Inventor: John E. Bianchi, Temecula, Calif.

[73] Assignee: Bianchi International, Temecula, Calif.

[21] Appl. No.: 122,077

[22] Filed: Nov. 17, 1987

[51] Int. Cl.[4] ..... F41C 33/02

[52] U.S. Cl. ..... 224/193; 224/911

[58] Field of Search ..... 224/193, 911, 192, 247

[56] References Cited

U.S. PATENT DOCUMENTS 981,292 1/1911 Lewis ..... 224/193

2,001,321 5/1935 Berns ..... 224/911 X 3,630,420 12/1971 Bianchi ..... 224/193

3,804,306 4/1974 Azurin ..... 224/193

*Primary Examiner*—Renee S. Luebke

*Attorney, Agent, or Firm*—John E. Wagner

[57] ABSTRACT

A holster which comprises a body of leather, leather-like or fabric material folded to define a pouch is described. The edge opening of the holster is closed by the spring of the invention. The spring lies, in part, between the outer body layer and an inner liner. The spring extends outside of, or is exposed to the holster body. The spring is secured to the holster by a suitable method such as a cover plate, a pair of rivets or an adhesive.

19 Claims, 4 Drawing Sheets

HOLSTER WITH INTERCHANGABLE SPRING

BACKGROUND OF THE INVENTION

In the development of the modern day holster, the presence of internal spring members to define the shape of the holster pouch and to control the forces on withdrawal of a handgun carried in the holster is well established. As early as 1926, Arth, in his U.S. Pat. No. 1 601,063, disclosed the use of a generally "C" shaped metal spring to encirle the cylinder region of an edge opening holster, to hold the opening closed during normal carrying and to provide a controlled release force for the handgun when drawn through the edge opening.

Through the years, many variations on the shape and materials have developed such as the use of formed flat sheet instead of wire forms for the spring. A number of such variations are represented by the following patents as well as other unpatented designs of spring holsters:

| U.S. Pat. Nos. | | |
|---|---|---|
| 3,630,420 | Bianchi | Wire "U" shaped spring |
| 3,749,293 | Bianchi | "L" shaped spring |
| 3,847,315 | Bianchi | "C" shaped spring clip holster |
| 3,977,583 | Bianchi et al. | Interlocking wire spring holster |
| 4,065,039 | Bianchi et al. | Interlocking wire spring holster |
| 4,277,007 | Bianchi et al. | Formed sheet metal springs |
| 4,542,841 | Bianchi et al. | "U" Shaped wire spring |
| 4,084,734 | Bianchi et al. | "U" Shaped wire spring |

Characteristic of these inventions and prior use of springs is the fact that the springs are located internal to the leather or leather-like holster body and are not visible. Protection for the body of the handgun is provided by a holster body and usually an inner lining of soft leather or suede-like material with the spring located between the two layers. The internal location of the spring protects the hangun from contact with the metal spring. The life of the holster is determined, in part, by the life of the resiliency of the spring material. If a spring loses its resilience after extended use or after an oversized handgun has been improperly carried in the holster, the holster's useful life is at an end. Replacement of the internal spring is often impractical is not impossible without permanent damage to the holster body.

In one case, applicant John E. Bianchi has invented a totally exposed, rubber or vinyl covered spring, namely in U.S. Pat. No. 3,847,315 cited above, in which the underarm holster is a "C" shaped clip member without any leather or fabric body involved.

Spring closed holsters have largely been used in the concealment type and law enforcement holster fields. Because concealment holsters are worn under outer garments, it is important that such holsters both become comfortable when worn in close proximity to the body, yet fit well and in an nonobtrusive manner. With extended use, concealment holsters conform to the wearer's body and therefor become more comfortable, but the spring may lose its resiliency. The wearer cannot continue to use his holster as the spring loses its resiliency no matter how comfortable and well fitting the holster has become. He must replace it and go through another break-in period for a new holster.

The method of manufacture of holsters including springs has undergone many variations, most of which have been compromises. For example, they include:

(a) forming the holster body flat, edge stitching it with a spring blank in place between the holster body and its lining, folding the holster body into the pouch shape employing force to postform the spring into its final shape; and sewing the pouch;

(b) sewing the holster body and lining flat and leaving an unsewn edge region; forming the spring into its final form; folding and forming the pouch; inserting the spring between the holster body and the lining through the unsewn edge portion and stitching the unsewn portion closed.

Each of these methods, as indicated above, are compromises and not totally acceptable for efficient production and holster performance. In each case, the mating of the metal spring with the leather or fabric holster body causes an interruption in the sewing process and, in the case of the postforming of the spring after sewing into the holster body, results in a spring without optimum heat treatment for gun retention and useful holster life.

Ideally, the spring is fully formed and heat treated prior to its introduction into the holster and all holster sewing has been completed prior to integration of the spring. This has not been successfully accomplished prior to this invention.

As an additional advantage of this invention, a fully symmetrical spring may be used. A spring design is not limited by the holster body manufacturing method limitations. Symmetry in design of the spring is essential to the ambidextrous holster, so this holster and method are particularly adapted to such use.

BRIEF STATEMENT OF THE INVENTION

We have found that the discarding of an otherwise fully serviceable holster because of a worn spring is no longer a necessity. We have learned that the same effectiveness of a preformed internal metal spring can be obtained when a spring is inserted from the exterior of the holster after assembly. Manufacture of a holster including a spring is greatly simplified since the leather portions are sewn while flat and the metal spring is formed into its final form, and two parts mated thereafter. A novel method of manufacture results.

We have also learned that the spring portions which remain exposed after insertion in a holster can provide an attractive accent to the appearance of the holster. A suitable form of attachment of the spring to the holster body is used. If the spring needs to be replaced for any reason, one will only remove any spring securing means, e.g. drill out rivets, remove the old spring, replace the old spring with a new spring and rivet or otherwise secure the spring to the holster body. This restores the holster to effective service.

Accordingly, we have invented a new holster which comprises a body of leather, leather-like or fabric material folded to define a pouch for holding a handgun. In one case, the holster includes an integral hood portion which encloses the hammer region of the handgun at the top and an edge opening body which encloses the barrel portion of the handgun. The edge opening of the holster is closed by the spring of this invention. The spring lies in part between the outer body layer and an inner liner used to protect the finish of the handgun. The spring, contrary to prior art holsters, extends outside of or is exposed to the extension of the holster body at the rear of the holster, at least during manufacture while preformed and in its designed location in the holster.

The holster body includes either a single large opening or a pair of slots at the fold of the holster through which the sheet metal spring extends from the exterior to between the layers of the holster with the bight or bend portion of the spring remaining outside of the holster body or at least exposed to the exterior. The spring is secured to the holster by suitable means such as an ornamented cover plate, by a pair of rivets or by adhesive.

In one form, as an underarm holster, the holster includes a shoulder harness which engages metal rings at the top of the hood portion of the holster. The spring, exposed at the fold of the holster, may be surface treated as by plating and may carry embossing thus providing an attractive accent to the leather or fabric holster body. Therefore, this invention not only facilitates assembly and allows replacement of worn springs but also provides an ornamental feature to the holster, not heretofore practical.

Following the method of this invention, the holster body manufacturing steps are carried on, independent of the spring manufacture and the two joined after virtually all sewing steps have been completed. The spring is inserted into an opening or slots in the fold of the holster body to remain exposed or covered by an ornamental plate. Optionally the spring or the cover plate may be secured to the holster body, as by riveting. No rivets need pass through the spring. The spring may be free to move within the holster body or be riveted in place. In any event, it is effectively secured in place by the cover plate.

At any time when the spring needs to be replaced, the cover plate is removed by punching out any securing means, the spring unsecured, slipped out of the slots or opening and a replacement spring slipped into place and the cover plate reinserted. Effectively, a new holster results.

BRIEF DESCRIPTION OF THE DRAWINGS

This invention may be more clearly understood from the following specification and by reference to the drawings, in which.

DETAILED DESCRIPTION OF THE INVENTION

Figure 1:
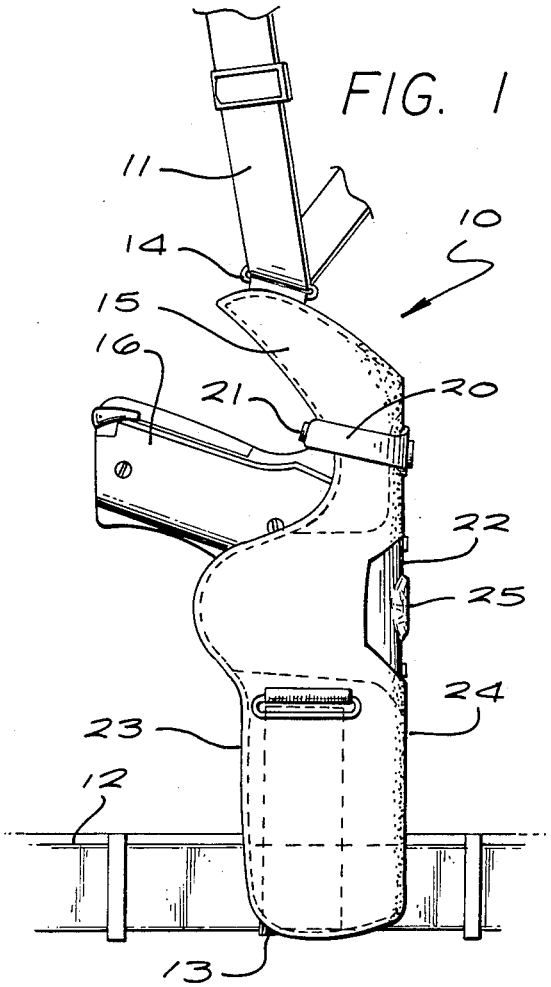
FIG. 1 is a perspective view of an underarm holster being worn and incorporating this invention.

Now referring to FIG. 1, an ambidextrous underarm holster 10 may be seen carried on a shoulder strap 11 and secured to the wearer's belt 12 by a belt strap 13 which is largely concealed by the holster 10. A "D" ring 14 at the upper end of the holster 10 is secured to the shoulder strap 11 while the strap 13 secures the lower end of holster 10 to the wearer's belt 12. The holster 10 includes a hood portion 15 which covers the hammer region of a handgrun 16 such as a large 4 to 5 inch barrel automatic or a 4 inch barrel medium frame revolver. A safety strap 20 encircles the holster above the handgun grip and includes an end tab 21 releasable by the user's thumb.

Holsters of the type shown in FIG. 1 are genreally known as spring loaded or edge opening in that the handgun is not removed by lifting from the holster but by rather drawing through an edge opening which is maintained closed by an internal spring.

Figure 2:
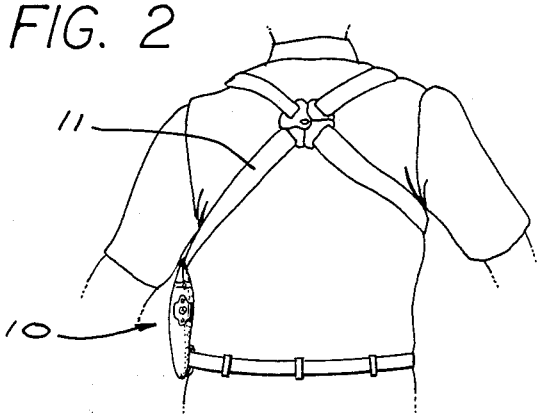
FIG. 2 is a rear view of a wearer showing the strap arrangement.
Figure 3:
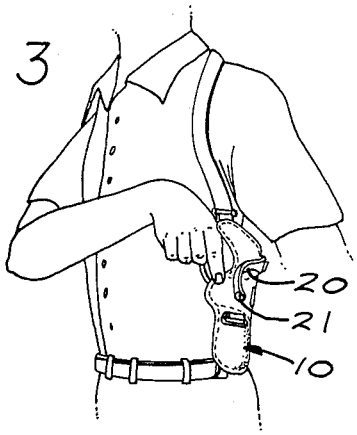
FIG. 3 is a perspective view showing the holster in right hand cross draw use.
Figure 4:
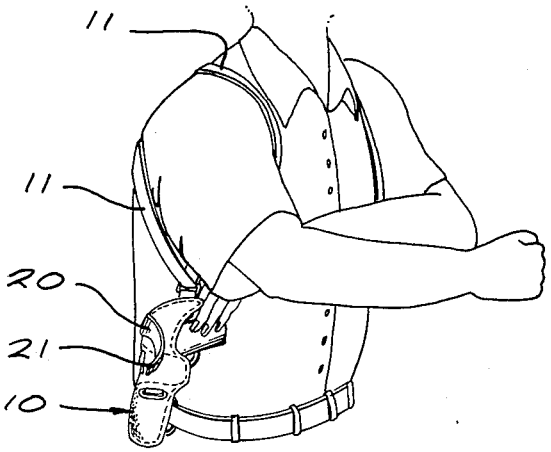
FIG. 4 is a perspective view showing the holster in left hand cross draw use.

Several views of the holster 10 and its shoulder harness 11 appear in FIGS. 2 through 4, including FIGS. 3 and 4 demonstrating the method of drawings a handgun from the holster described above.

As is described above, this holster appears to be like any conventional underarm holster fabricated of either leather or fabric and having an internal spring. One visible difference however, is a plate or cover 22 best seen in FIGS. 5 and 6 located approximately midway along the length of the handgun pocket and on the folded edge 24 opposite the handgun removal slot 23. This plate 22 is curved and as seen in FIG. 6 and is of metal and emerging from the folded edge 24 of the holster body 10. The plate 22 includes a center ornamental embossment 25 and is secured to the holster by securing means such as a pair of rivets 26.

Figure 8:
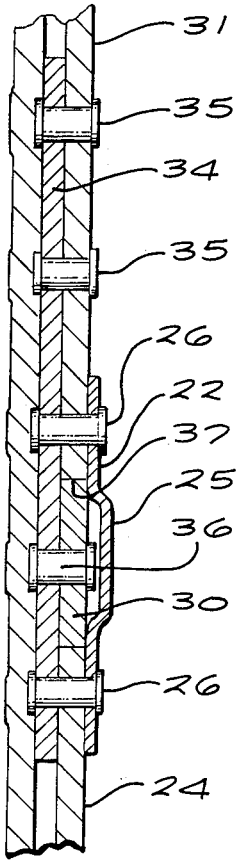
FIG. 8 is a horizontal sectional view taken along lines 8—8 of FIG. 7.
Figure 7:
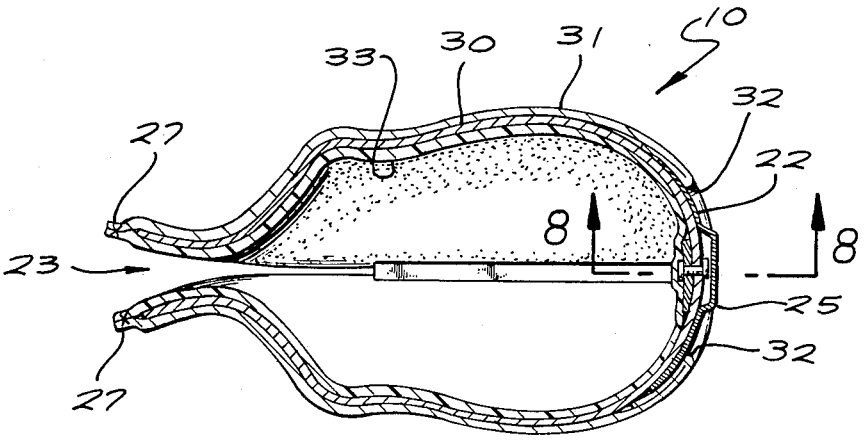
FIG. 7 is a fragmentary vertical sectional view taken along lines 7—7 of FIG. 6.

The plate 22 is shown ornamented with an emblem and in such case it is preferably fabricated of stainless steel and, in fact, is a cover plate for a spring 30 appearing in FIGS. 7 and 8.

For more features of the holster, reference is now made to Figs. 6, 7, and 8 showing this invention in more detail. As may be seen in FIG. 6, the plate 22 extends inside the holster body's outer surface 31 through a pair of slots 32, one on each face of the holster 10. The internal portion of cover 22 is represented by dash-dot lines while the spring 30 in FIG. 6 is represented by dashed lines. The plate 22 may be a substitute for the spring 30 of the holster 10 or may be, as illustrated here, a cover for that spring. In either event, the spring 30 extends into the holster body 10 following the dash lines 30 of FIG. 6 nearly to the outer edge seam 27. The spring 30 is located between the plate 22 and the lining 33 of FIGS. 7 and 8 which may be a suede like lining for protecting the finish of the handgun. The spring 30 may be symmetrical, in contrast with such asymmetrical spring designs as disclosed by the Arth patent referenced above. Symmetry allows the holster to be used ambidextrously.

Now referring to FIGS. 7 and 8, this latter figure is a vertical sectional view. In FIGS. 7 and 8, the multiple layers are more clearly apparent. The outer layer termed the holster body 31 is preferably of leather or leather-like material or, in certain embodiments, is fabricated from nylon fabric of the type disclosed in my patent 4,627,558.

Figure 5:
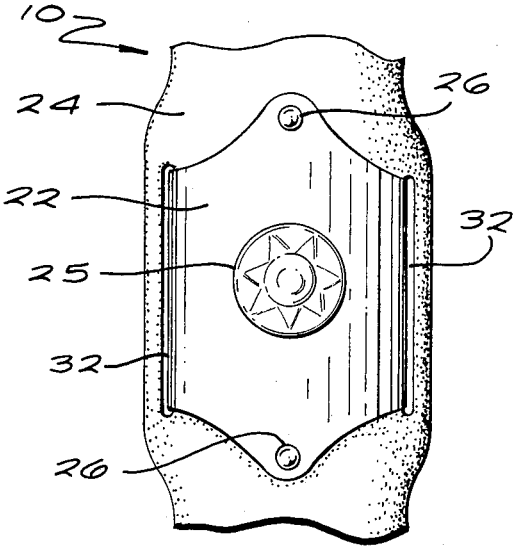
FIG. 5 is a fragmentary front elevational view of a holster employing this invention.
Figure 6:
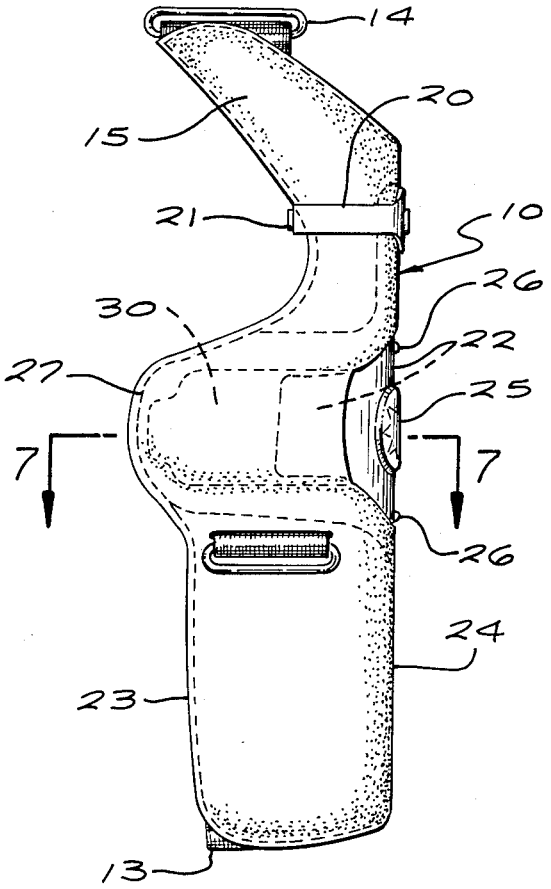
FIG. 6 is a side elevational view thereof.
Figure 9:
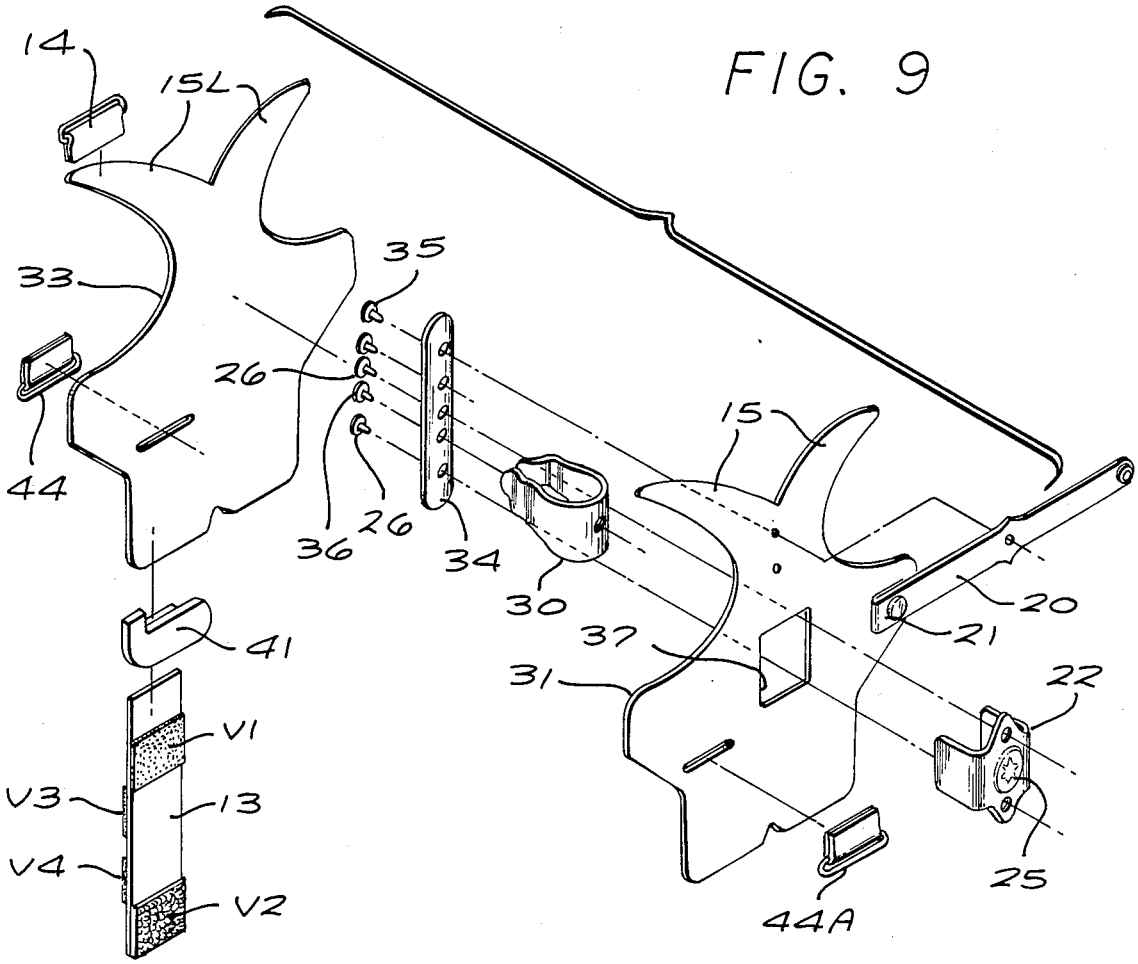
FIG. 9 is an exploded view thereof.

The holster body 31 includes the slots 32 as shown in FIG. 5 or a rectangular opening 37 as shown in FIGS. 7, 8 and 9 adjacent to the fold of the holster. The plate 22 extends through the slots 32 or opening 37 with the central portion including the embossment 25 outside of the holster body 31.

Beneath the holster body 31 is a liner 33 stitched at its edge to the body 31 by stitch line 27 of FIG. 6. Spring 30 lies between the outer body 31 and the liner 33. A stiffener 34 is optionally riveted to the body 31 by rivets 35. An additional rivet 36 secures the spring 30 to the stiffener 34.

As you can see in FIGS. 7 and 9, the spring has been formed to the precise shape required for the holster 10. As will be described below in connection with the method of production of this invention, the spring 30 has been fully fabricated and heat treated prior to mating with the leather or fabric portions of the holster. Whatever the optimum shape for the spring, that shape may be produced and used. The shape of the spring 30 is not limited by sewing procedures. As is apparent in FIGS. 8 and 9, spring 30 is symmetrical.

METHOD OF THIS INVENTION

Figure 10:
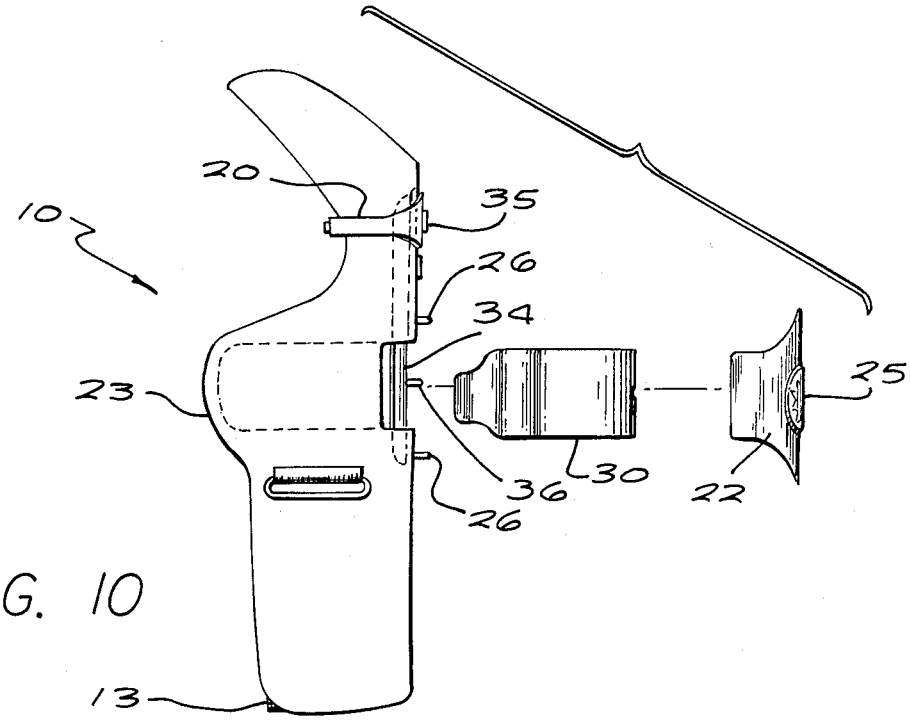
FIG. 10 is a side elevational view of the holster of FIG. 6 with the spring and cover plate exploded.
Figure 11:
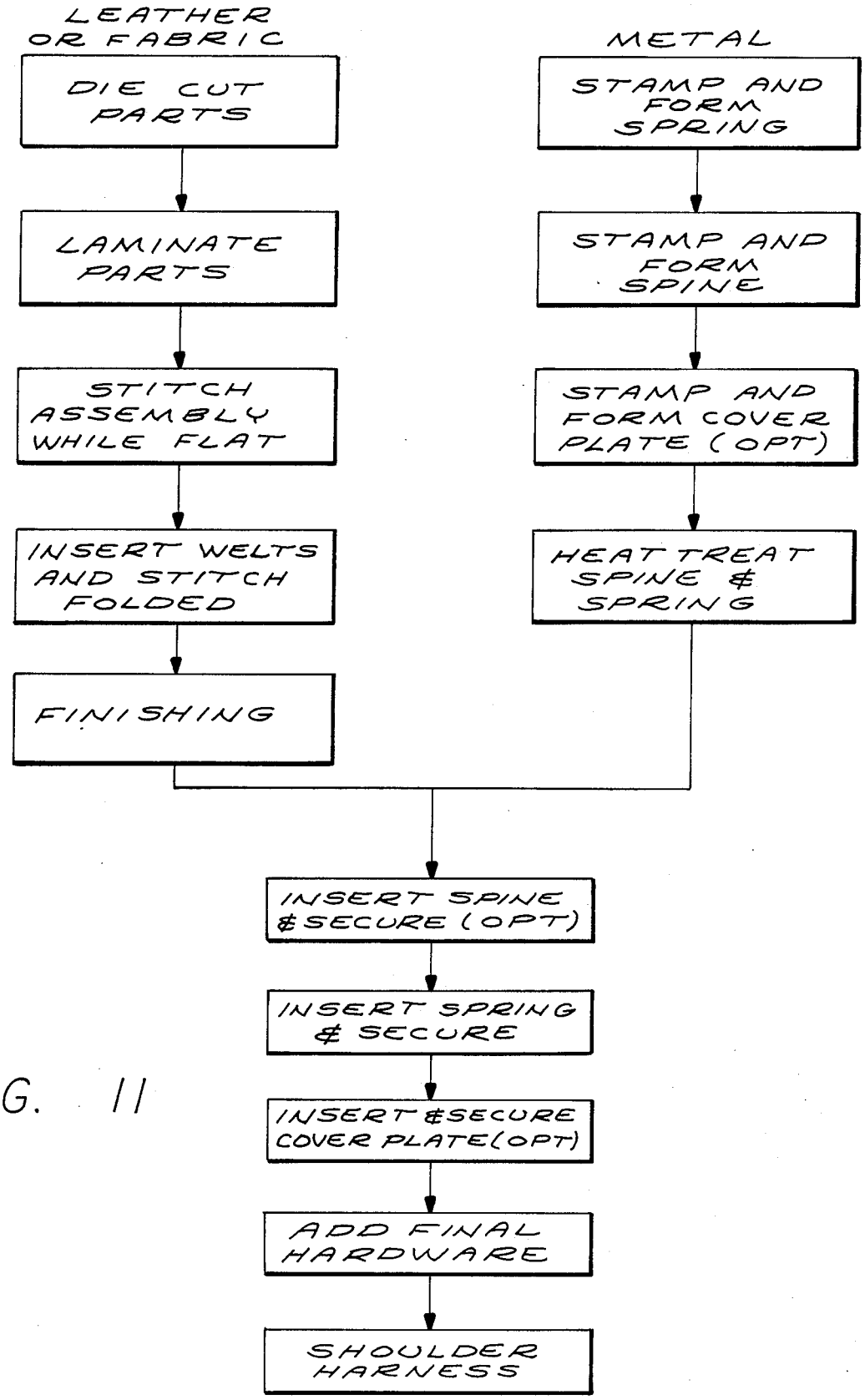
FIG. 11 is a flow diagram of the method of manufacturing holsters according to this invention.

The process for fabricating and assembling a holster in accordance with this invention may be best understood by reference to FIGS. 9–11. FIG. 9 shows an exploded view of various parts of a holster 10 fabricated employing the method outlined on FIG. 11. In FIG. 9, beginning at the top, the liner 33 may be seen with a "D" ring 14 with its securing tab located approximately above its point of insertion during the stitching process.

At the bottom of the liner 33 is a welt 41 and belt strap 13 with double sided hook and pile fastener fabric, one side sections V1 and V2 to be engaged when the strap 13 is folded over a belt for one side wearing, and the second side, sections V3 and V4 to be engaged when the holster is worn on the other side.

Inside the liner 33 are rivets 26, 35 and 36 and stiffener 34. Partially inside the holster are the legs of spring 30 and when completed, the legs of cover plate 25. The safety strap 20 is secured outside of the holster body 31 is uppermost rivet 35 which also passes through the stiffener 34 and an opening in the holster body 31. A second "D" ring 44A, the matching opposite "D" ring to 44, completes the holster.

Although the above has been described in assembly terms, in reality, the description of FIG. 9 is principally a description of the layers in their operative relationships. It clearly appears in FIG. 9 that the spring 30, stiffener 34 and spring cover 22 are formed to their final shape prior to mating with the leather or fabric parts, but the remainder of the parts are all shown in their flat shape.

Fabrication of the holster in accordance with this invention is accomplished in accordance with the flow diagram of FIG. 11.

Now referring to FIG. 11, the fabrication occurs in two branches, the leather and fabric processing and the metal processing.

LEATHER OR FABRIC FORMING STEPS

In the leather or fabric processing, these parts are die cut to size and shape and to create any cutouts which may be required, including slots 32.

The flexible parts are next, optionally laminated together using a suitable adhesive except for the area where the spring 30 will be located. In leather holsters, laminating is normal. For fabric holsters, laminating is optional.

Next, the leather or fabric assembly is stitched together. This typically involves the edge stitching 27 which appears in FIG. 6. In as much as the fabric or leather assembly is flat, the edge stitching is a simple operation on a conventional commercial sewing machine.

Next, the complete formation of the holster body except for metal parts is accomplished by inserting and stitching and/or cementing welts at the appropriate locations and tabs with their "D" rings.

Next, the holster 10 is folded to its pouch forming shape and any stitching producing the folded shape e.g. pouch and the hood 15 is completed at this time. In certain cases, such as the hood which is stitched together, the "D" ring 14 and its looped tab, the step of flat stitching in that region is omitted since one stitch line in forming the hood serves the function of holding the flat parts together and forms the fold, as well.

Next, any finishing such as polishing is completed on traditional leather models. With the completion of this last step, the holster is ready for the addition of metal parts.

METAL FORMING STEPS

The metal fabrication is accomplished by stamping and deburring the spring from 0.035–0.040 inch sheet stock. Next, the spring 30 is formed into its precise finished shape and heat treated to its precise requirements e.g. a Rockwell C hardness of (46–48). Any post heat treatment desired or finish is accomplished next. The spine is also stamped, punched and formed into a concave shape and heat treated. Next, the cover plate is formed and the surface treated, for example, by being embossed and/or plated.

HOLSTER ASSEMBLY

Next, the spring legs are spread and inserted in the two slots 32 of the formed holster. The spring 30 provides shape retention and the resistance to opening for the successful operation of the holster. The rivet 36 is headed to secure spring 30 and spine 34 in place. The spring cover 22 is similarly inserted partially through the slots 32 and the rivets 26 placed and headed through the liner 33 so that the spring cover 22 is secured in place.

Next, final hardware such as the safety strap 20 is added by heading the final rivets 35. Suitable shoulder straps 11 as illustrated in FIG. 1 are added and the holster is completed.

If ever during the life of the holster the spring 30 loses its resiliency, it may be replaced by drilling out the two rivets 26, removing the plate 22, removing the non-resilient spring 30, replacing with a resilient spring 30, and reriveting plate 22 in position. The operation is illustrated by exploded view 10.

CONCLUSION

From the foregoing it may be seen that I have developed a new holster providing replaceable springs. I have also invented a new method of fabricating holsters consistent with the best techniques for fabricating leather parts, for fabricating metal springs and mating the two in providing an effective and attractive spring holster.

This invention has been disclosed in the best mode known, namely in an underarm cross draw holster. The principle of invention is equally applicable to belt holsters, as well. Any spring closed holster can use the benefits of this invention.

This invention shall not be limited to the illustrative embodiment but rather to the claims as set forth below which constitute definitions of this invention including the protection afforded by the doctrine of equivalents.

What is claimed is:

1. A holster having a spring closed opening comprising: a holster body of material formed to define a pocket for holding a handgun and defining an opening for the insertion and withdrawal of a handgun;

a spring engaging said body for maintaining said opening at least partially closed to aid in retaining a handgun in said holster;

said body defining a second opening therein through which at least part of said spring extends between the exterior and interior of said body whereby said spring may be inserted or removed from said holster after said holster body is formed into a pocket; said holster being lined and at least a portion of said spring extending into the holster body lying between the holster body and lining thereof.

2. A holster in accordance with claim 1 including ornamental means overlying said spring at least in the region of said spring exposed to the exterior of said holster body.

3. A holster in accordance with claim 1 wherein said holster is edge opening with a fold opposite the edge opening and said spring enters the holster from the fold of said holster body.

4. A holster in accordance with claim 1 or 3 wherein said spring is generally "C" shaped with the legs thereof extending into said holster body.

5. A holster in accordance with claim 3 wherein said holster body includes a pair of slots in the fold portion thereof and wherein said spring extends into said holster body through said slots.

6. A holster in accordance with claim 5 including means between said slots securing said spring to said holster body.

7. A holster in accordance with claim 6 wherein said securing means comprises at least one rivet.

8. A holster comprising a holster body of flexible material folded into a pocket with a first opening between edges of said holster body;

a flexible liner within said holster body;

said holster body including a second opening in the region of the fold thereof;

a spring extending from the exterior of said holster body through said second opening and lying between said holster body and said flexible liner.

a portion of said spring extending into said second opening and biasing said first opening into a handgun-holding partially closed position.

9. A spring holster comprising:

a multilayered holster body of flexible material formed to define a pouch for holding a handgun and having a primary opening for the insertion and removal of a handgun and at least one secondary opening through the surface thereof;

spring means or mechanically biasing at least part of said primary holster body opening to a generally closed position;

said spring means extending through said secondary opening in the surface of said holster body and between layers of said holster body whereby said spring means is not exposed to the interior of said holster.

10. A spring holster in accordance with claim 9 wherein said holster body is formed with a fold at one edge and the handgun insertion and removal opening at the opposite edge thereof;

said secondary opening being located at the fold of said holster body whereby said spring means may be introduced into the holster body from the fold and extend toward said primary opening.

11. A spring holster in accordance with claim 9, in which said spring means is "C" shaped with the legs of the spring extending into said holster body with one leg on each side of said primary opening and the center of said "C" shaped spring located in the region of said secondary opening in said holster body.

12. A spring holster in accordance with claim 9 wherein said secondary opening comprises a pair of slots and said spring means extends into said holster body through said slots.

13. A spring holster in accordance with claim 12 including cover means overlying said spring means and including a pair of legs, one of said legs extending into said holster body through said slots.

14. A spring holster in accordance with claim 9 including cover means for said spring means;

said cover means overlying at least the exposed portions of said spring means;

and means securing said cover means in place.

15. A spring holster in accordance with claim 14 wherein said cover means includes portions thereof extending into the secondary opening in said holster body.

16. A spring holster in accordance with claim 14 wherein said spring means and said cover means are generally "C" shaped with the respective legs thereof extending into said holster body through said secondary opening with said cover exposed in the region of said secondary opening.

17. A spring holster in accordance with claim 14 wherein said cover includes ornamentation on the portion thereof exposed at said secondary opening.

18. A spring closed holster comprising:

a holster body of leather or fabric defining a pouch for holding a handgun;

an opening in said holster body for the insertion of an end portion of a holster biasing spring from the outside of the holster body;

a holster biasing spring dimensioned to pass at least partially through said opening in the holster body; and means including a removable cover retained in place on said holster body in a position overlying a portion of said spring protruding from said opening for securing said spring to the holster body.

19. A holster in accordance with claim 18 wherein said securing means comprise an ornamental cover for said opening.

* * * * *